US008354020B2

(12) United States Patent
Sharma et al.

(10) Patent No.: US 8,354,020 B2
(45) Date of Patent: Jan. 15, 2013

(54) FOULING REDUCTION IN A PARAFFINIC FROTH TREATMENT PROCESS BY SOLUBILITY CONTROL

(75) Inventors: Arun K. Sharma, Missouri City, TX (US); Eric B. Sirota, Flemington, NJ (US); Michael F. Raterman, Doylestown, PA (US)

(73) Assignee: ExxonMobil Upstream Research Company, Houston, TX (US)

( * ) Notice: Subject to any disclaimer, the term of this patent is extended or adjusted under 35 U.S.C. 154(b) by 533 days.

(21) Appl. No.: 12/464,728

(22) Filed: May 12, 2009

(65) Prior Publication Data

US 2009/0321324 A1 Dec. 31, 2009

Related U.S. Application Data

(60) Provisional application No. 61/133,268, filed on Jun. 27, 2008.

(51) Int. Cl.
*C10G 1/04* (2006.01)

(52) U.S. Cl. ..... 208/390

(58) Field of Classification Search ..... 208/390
See application file for complete search history.

(56) References Cited

U.S. PATENT DOCUMENTS

| | | | |
|---|---|---|---|
| 4,035,282 | A | 7/1977 | Stuchberry et al. |
| 4,676,889 | A | 6/1987 | Hsieh et al. |
| 4,702,815 | A | 10/1987 | Prestridge et al. |
| 5,236,577 | A | 8/1993 | Tipman et al. |
| 5,871,634 | A | 2/1999 | Wiehe et al. |
| 5,997,723 | A | 12/1999 | Wiehe et al. |
| 6,210,560 | B1 | 4/2001 | Wiehe et al. |
| 6,355,159 | B1 | 3/2002 | Myers et al. |
| 6,860,979 | B2 | 3/2005 | Sams |
| 7,141,162 | B2 | 11/2006 | Garner et al. |
| 7,351,320 | B2 | 4/2008 | Sams |
| 2003/0029775 | A1 | 2/2003 | Cymerman et al. |

FOREIGN PATENT DOCUMENTS

| | | | |
|---|---|---|---|
| CA | 1 138 361 | | 12/1982 |
| CA | 2 502 329 | A1 | 9/2006 |
| CA | 2 547 147 | A1 | 11/2006 |
| WO | WO 2006/057688 | A2 | 6/2006 |

OTHER PUBLICATIONS

Thomason, William H. et al., "Advanced Electrostatic Technologies for Dehydration of Heavy Oils", SPE/PS-CIM/CHOA 97786, 2005 SPE International Thermal Operations and Heavy Oil Symposium, Nov. 1-3, 2005, pp. 1-7, Calgary, AB, Canada.

Wiehe, I. A., et al. (2000), "The Oil Compatibility Model and Crude Oil Incompatibility", *Energy & Fuels* 2000, 14, 56-59.

Wiehe, I. A., et al. (2000), "Application of the Oil Compatibility Model to Refinery Streams", *Energy & Fuels* 2000, 14, 60-63.

*Primary Examiner* — Randy Boyer

(74) *Attorney, Agent, or Firm* — ExxonMobil Upstream Research Company-Law Department

(57) ABSTRACT

The disclosure relates to improved bitumen recovery processes and systems. In particular, the disclosure teaches processes and systems for recovering heavy crude oil while avoiding fouling of equipment by recycling at least a portion of a product bitumen from a solvent recovery unit for mixing with an overhead bitumen stream that may be a diluted bitumen stream containing solvent and bitumen. The overhead bitumen stream is a near-incompatible stream and the stream of mixed overhead bitumen stream and the treated bitumen stream is a compatible stream that will not foul equipment upon heating.

10 Claims, 4 Drawing Sheets

FOULING REDUCTION IN A PARAFFINIC FROTH TREATMENT PROCESS BY SOLUBILITY CONTROL

CROSS REFERENCE TO RELATED APPLICATION

This application claims the benefit of U.S. Provisional Application No. 61/133,268, filed Jun. 27, 2008.

FIELD OF THE INVENTION

The present invention relates generally to producing hydrocarbons. More specifically, the invention relates to methods and systems for upgrading bitumen in a solvent based froth treatment process.

BACKGROUND OF THE INVENTION

The economic recovery and utilization of heavy hydrocarbons, including bitumen, is one of the world's toughest energy challenges. The demand for heavy crudes such as those extracted from oil sands has increased significantly in order to replace the dwindling reserves of conventional crude. These heavy hydrocarbons, however, are typically located in geographical regions far removed from existing refineries. Consequently, the heavy hydrocarbons are often transported via pipelines to the refineries. In order to transport the heavy crudes in pipelines they must meet pipeline quality specifications.

The extraction of asphaltene-containing oils (e.g., heavy oil and bitumen) from mined oil sands involves the liberation and separation of bitumen from the associated sands in a form that is suitable for further processing to produce a marketable product. Among several processes for bitumen extraction, the Clark Hot Water Extraction (CHWE) process represents an exemplary commercial recovery technique. In the CHWE process, mined oil sands are mixed with hot water to create slurry suitable for extraction as bitumen froth.

After extraction, the heavy oil slurry (e.g., bitumen froth) may be subjected to a paraffinic froth treatment process. In such a process, the slurry or froth may be introduced into a froth separation unit (FSU) wherein the froth is separated into a diluted bitumen stream and a tailings stream. The diluted bitumen stream may be directed to a solvent recovery unit (SRU) for flashing or other processing to produce a hot bitumen product stream and a solvent stream. The hot bitumen product stream may be sent to a pipeline for production and the solvent stream may be recycled in the treatment process. The diluted bitumen stream is an asphaltene-containing oil and very often is a "near-incompatible" oil.

A "near-incompatible" oil is an oil that is close to the conditions (e.g., composition, temperature, pressure, etc.) for precipitating asphaltenes. Asphaltene precipitation results in the deposition of organic solids, such as foulant and coke, on equipment such as refinery process equipment that contact the oil. Even small amounts of foulant or coke on such equipment results in large energy loss because of much poorer heat transfer through the foulant and coke as opposed to metal walls alone. Moderate amounts of foulant and coke cause high pressure drops and interfere with and make process equipment operation inefficient. Significant amounts of foulant or coke may plug up process equipment to prevent flow or otherwise make operation intolerable, requiring the equipment to be shut down and cleaned.

U.S. Pat. No. 5,871,634 discloses a method for blending potentially incompatible petroleum oils. The method includes determining insolubility numbers for the separate oils and a solubility blending number for the mixed oils and calculating a ratio of oils to produce a compatible mixture. U.S. Pat. No. 5,997,723 discloses a similar method for blending near or potentially incompatible petroleum oils.

Asphaltene precipitation leads to fouling of equipment in heavy oil recovery processes, which significantly impact the efficiency of such heavy hydrocarbon (e.g., bitumen) recovery processes. As such, there exists a need in the art for efficient, low cost methods and systems to produce pipeline specification bitumen that do not foul the process equipment. In particular, methods and systems that efficiently generate compatible oil streams during heavy hydrocarbon recovery processes are needed.

SUMMARY OF THE INVENTION

In one aspect of the invention, a method of recovering hydrocarbons is provided. The method includes producing a bitumen (or other heavy oil) froth stream including solvent and asphaltenes; sending at least a portion of the bitumen stream to an overhead line (the overhead bitumen stream), wherein the overhead bitumen stream is a near-incompatible stream including solvent; providing a solvent recovery unit configured to produce a bitumen product stream and a solvent stream; diverting at least a portion of the bitumen product stream (the diverted bitumen product stream) to a mixing unit; and mixing the overhead bitumen stream with the diverted bitumen product stream in the mixing unit to produce a compatible mixed bitumen stream. The method may further include determining an incompatibility number ($I_N$) for the overhead bitumen stream; determining a solubility blending number ($S_{BN}$) for the compatible mixed bitumen stream; and calculating the ratio of the overhead bitumen stream to the bitumen product stream that results in a compatible mixed bitumen stream having a mixed solubility blending number ($S_{BNmix}$) greater than the incompatibility number of the overhead bitumen stream.

In certain particular embodiments of the disclosed methods, the solvent in the near-incompatible overhead bitumen stream has a flow rate to the mixing unit, the diverted bitumen product stream has a flow rate to the mixing unit, and a ratio of the flow rate of the solvent in the overhead bitumen stream to the diverted bitumen product stream is configured to increase a solubility parameter of the compatible mixed bitumen stream. Further, the solubility parameter of the compatible mixed bitumen stream is greater than a compatibility limit of the compatible mixed bitumen stream. In addition, the ratio of the overhead bitumen stream to the bitumen product stream is selected from the group of ratios consisting of a volume ratio, a mass ration, a weight ratio, a molar ratio, a volume flow rate ratio, a mass flow rate ratio, a weight flow rate ratio, and a molar flow rate ratio; the overhead bitumen stream is at a temperature of from about 50 degrees Celsius (° C.) to about 90° C. and the heated mixed bitumen stream is at a temperature of from about 100° C. to about 150° C.; the solvent is selected from the group comprising: butanes, pentanes, heptanes, octanes, and any combination thereof, and the volume ratio of solvent to bitumen in the compatible mixed bitumen stream is less than about 2:1.

In another aspect of the invention, a system for recovering hydrocarbons is provided. The system includes a bitumen froth inlet stream including solvent and asphaltenes; a froth separation unit configured to receive the bitumen froth inlet stream and produce at least an overhead bitumen stream, wherein the overhead bitumen stream is a near-incompatible stream including solvent and asphaltenes; a solvent recovery unit configured to produce at least a bitumen product stream and a solvent recycle stream; a bitumen mixing unit configured to mix at least a portion of the bitumen product stream with at least a portion of the overhead bitumen stream to generate a mixed bitumen stream. The system may further include a monitoring and control system. The monitoring and control system including a volume or mass sensor configured to sense the volume or mass of the overhead bitumen stream; a solvent sensor configured to sense the ratio of solvent to bitumen in the overhead bitumen stream; and a mixing controller configured to control the ratio of the overhead bitumen stream to the bitumen product stream. The control system may be configured to determine an incompatibility number ($I_N$) for the overhead bitumen stream; determine a solubility blending number ($S_{BN}$) for the mixed bitumen stream; calculate the ratio of the overhead bitumen stream to the bitumen product stream that results in a mixed bitumen stream having a mixed solubility blending number ($S_{BNmix}$) greater than the incompatibility number of the overhead bitumen stream; and change the ratio of the overhead bitumen stream to the bitumen product stream based on the calculation.

In certain particular embodiments of the disclosed systems, the controller may be an automatic controller or a manual controller. In addition, the system may further include a heating unit configured to heat the compatible mixed bitumen stream to form a heated compatible mixed bitumen stream, wherein the heated compatible mixed bitumen stream is fed to the solvent recovery unit (SRU); and the overhead bitumen stream includes solvent, wherein the solvent has a flow rate to the overhead mixer, the diverted bitumen product stream has a flow rate to the overhead mixer, and a ratio of the flow rate of the solvent in the overhead bitumen stream to the diverted bitumen product stream is configured to increase a solubility parameter of the compatible mixed bitumen stream.

BRIEF DESCRIPTION OF THE DRAWINGS

The foregoing and other advantages of the present invention may become apparent upon reviewing the following detailed description and drawings of non-limiting examples of embodiments in which.

DETAILED DESCRIPTION

Figure 1:
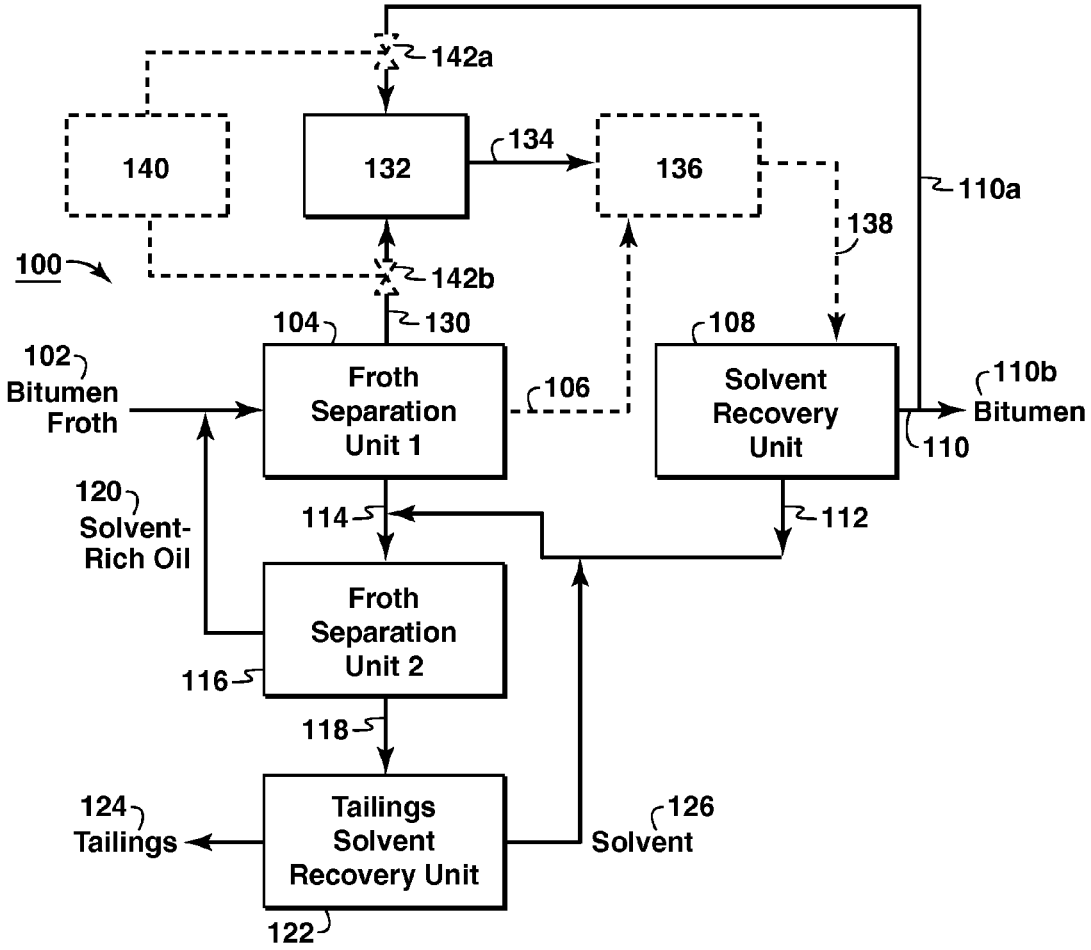
FIG. 1 is a schematic of an exemplary hydrocarbon recovery system of the present invention.

In the following detailed description section, the specific embodiments of the present invention are described in connection with preferred embodiments. However, to the extent that the following description is specific to a particular embodiment or a particular use of the present invention, this is intended to be for exemplary purposes only and simply provides a description of the exemplary embodiments. Accordingly, the invention is not limited to the specific embodiments described below, but rather, it includes all alternatives, modifications, and equivalents falling within the true spirit and scope of the appended claims.

The term "asphaltenes" as used herein refers to hydrocarbons which are the n-heptane insoluble, toluene soluble component of a carbonaceous material such as crude oil, bitumen or coal. One practical test to determine if oil is an asphaltene is to test whether the oil is soluble when blended with 40 volumes of toluene but insoluble when the oil is blended with 40 volumes of n-heptane. If so, the oil may be considered an asphaltene. Asphaltenes are typically primarily comprised of carbon, hydrogen, nitrogen, oxygen, and sulfur as well as trace amounts of vanadium and nickel. The carbon to hydrogen ratio is generally about 1:1.2, depending on the source.

The term "bitumen" as used herein refers to heavy oil. In its natural state as oil sands, bitumen generally includes asphaltenes and fine solids such as mineral solids.

The term "near-incompatible stream" as used herein refers to a heavy oil stream (either a single composition or a mixture of heavy oil streams) containing asphaltenes and solvent that is close to the limit of incompatibility. The limit of incompatibility is short-hand for the particular set of conditions at which the asphaltenes will drop out of the heavy oil stream. If the conditions and constitution of the stream are above the limit of compatibility, then the asphaltenes will not drop out of the stream. Put another way, a heavy oil stream is close to the limit of compatibility when a minor change in the conditions (e.g., heat, pressure) or composition will cause the stream to be below the limit of compatibility or the next process step will result in the stream being below the limit of compatibility.

The term "paraffinic solvent" (also known as aliphatic) as used herein means solvents containing normal paraffins, isoparaffins and blends thereof in amounts greater than 50 weight percent (wt %). Presence of other components such as olefins, aromatics or naphthenes counteract the function of the paraffinic solvent and hence should not be present more than 1 to 20 wt % combined and preferably, no more than 3 wt % is present. The paraffinic solvent may be a C4 to C20 paraffinic hydrocarbon solvent or any combination of iso and normal components thereof. In one embodiment, the paraffinic solvent comprises pentane, iso-pentane, or a combination thereof. In one embodiment, the paraffinic solvent comprises about 60 wt % pentane and about 40 wt % iso-pentane, with none or less than 20 wt % of the counteracting components referred above.

The invention generally relates to processes and systems for recovering hydrocarbons. In one aspect, the invention is a process to partially upgrade a bitumen or heavy crude and is particularly suited for bitumen froth generated from oil sands which contain bitumen, water, asphaltenes and mineral solids. The process includes extracting and producing heavy oil (e.g., bitumen) having asphaltenes from a reservoir in the form of a bitumen froth, sending at least a portion of the bitumen froth stream to an overhead line, wherein the overhead bitumen stream is a near-incompatible stream. The process further includes mixing the near-incompatible overhead bitumen stream with a bitumen product stream, which may be produced from a solvent recovery unit (SRU).

In one particular embodiment of the invention, the process further includes determining an incompatibility number ($I_N$) for the overhead bitumen stream and a solubility blending number ($S_{BNmix}$) for the mixed bitumen stream, then calculating the ratio of the overhead bitumen stream to the bitumen product stream that results in a mixed bitumen stream having a mixed solubility blending number ($S_{BNmix}$) greater than the incompatibility number of the overhead bitumen stream.

The bitumen froth may be processed in a froth separation unit (FSU) to produce the overhead bitumen stream and a tailings stream. The overhead bitumen stream may be a diluted bitumen stream having greater than a two to one volume ratio of solvent to bitumen and a near-incompatible stream. The treated bitumen stream may be produced by the SRU and may be a pipeline quality bitumen stream. The treated bitumen stream is preferably a compatible stream with a low solvent to bitumen ratio (e.g., less than about one to twenty). The process may further include heating the mixed bitumen stream and sending the heated mixed bitumen stream to the SRU.

In another aspect, the invention relates to a system for recovering hydrocarbons. The system may be a plant located at or near a bitumen (e.g., heavy hydrocarbon) mining or recovery site or zone. The plant may include at least one froth separation unit (FSU) having a bitumen froth inlet for receiving bitumen froth (or a solvent froth-treated bitumen mixture) and produce an overhead bitumen stream, wherein the overhead bitumen stream is a near-incompatible stream. The plant may further include a solvent recovery unit (SRU) configured to produce a bitumen product stream and a solvent stream, and a mixing unit configured to mix the bitumen product stream and the overhead bitumen stream to form a mixed bitumen stream. The plant may also include a heating unit for heating the mixed bitumen stream to form a heated mixed bitumen stream. The plant may further include at least one tailings solvent recovery unit (TSRU), solvent storage unit, pumps, compressors, and other equipment for treating and handling the heavy hydrocarbons and byproducts of the recovery system.

One particular embodiment of the system may further include a monitoring and control system including an automated controller. The automated controller is configured to determine an incompatibility number ($I_N$) for the overhead bitumen stream; determine a solubility blending number ($S_{BN}$) for the mixed bitumen stream; calculate the ratio of the overhead bitumen stream to the bitumen product stream that results in a mixed bitumen stream having a mixed solubility blending number ($S_{BNmix}$) greater than the incompatibility number of the overhead bitumen stream; and automatically change the ratio of the overhead bitumen stream to the bitumen product stream based on the calculation.

If the blending of two or more oils causes the precipitation of asphaltenes, the oils are said to be "incompatible" as opposed to compatible oils that do not precipitate asphaltenes on blending. Incompatible blends of oils have a much greater tendency for fouling and coking than compatible oils. If a blend of two or more oils have some proportion of the oils that precipitate asphaltenes, the set of oils are said to be potentially incompatible. Once an incompatible blend of oils is obtained, the resulting rapid fouling and coking usually requires shutting down the refinery process in a short time. This problem can result in a large economic debit because while the process equipment is cleaned, large volumes of oil cannot be processed.

Tests are available to predict whether two oil streams are compatible or not. One such test is discussed in U.S. Pat. No. 5,871,634 and includes determining the insolubility number ($I_N$) and the solubility blending number ($S_{BN}$) of each oil to be blended. The first step in determining the $I_N$ and the $S_{BN}$ for a petroleum oil is to establish if the petroleum oil contains n-heptane insoluble asphaltenes. This may be accomplished by blending 1 volume of the oil with 5 volumes of n-heptane and determining if asphaltenes are insoluble. Any convenient method might be used. One possibility is to observe a drop of the blend of test liquid mixture and oil between a glass slide and a glass cover slip using transmitted light with an optical microscope at a magnification of from about 50 to about 600 times. If the asphaltenes are in solution, few, if any, dark particles will be observed. If the asphaltenes are insoluble, many dark, usually brownish, particles, usually 0.5 to 10 microns (μm) in size, will be observed. Another possible method is to put a drop of the blend of test liquid mixture and oil on a piece of filter paper and let it dry. If the asphaltenes are insoluble, a dark ring or circle will be seen about the center of the yellow-brown spot made by the oil. If the asphaltenes are soluble, the color of the spot made by the oil will be relatively uniform in color.

Referring now to the figures, FIG. 1 is a schematic of an exemplary hydrocarbon recovery system in accordance with certain aspects of the disclosure. The system includes a plant 100 configured to receive a bitumen froth stream 102 from a heavy hydrocarbon recovery process. The bitumen froth stream 102 is fed into a first froth separation unit (FSU) 104. The FSU 104 is configured to produce at least an overhead bitumen stream 130, an optional bypass stream 106 (the bypass stream 106 may be a partial bypass stream) and a tailings stream 114. The plant 100 further includes a solvent recovery unit (SRU) 108, which produces at least a bitumen product stream 110 and a solvent stream 112. The bitumen product stream is then at least partially diverted into stream 110*a* and stream 110*b*, wherein stream 110*a* is sent to a mixing unit 132 where it is mixed with the overhead stream 130 to produce a mixed bitumen stream 134. In some embodiments, the plant 100 further includes a heating unit 136, which produces a heated mixed bitumen stream 138 to be fed into the SRU 108. The heating unit 136 may also be configured to heat the optional bypass stream 106.

In one exemplary embodiment, the plant 100 further includes a control unit 140 and may include valves 142*a* and 142*b* for controlling the flow of the diverted bitumen product stream 110*a* and the overhead bitumen stream 130 into the mixing unit 132. Although valves may be used, any means of controlling the relative flow of the streams 130 and 110*a* may be used. Other exemplary means include accumulation tanks, pumps, etc. The controller may further be coupled to sensors (not shown) which are configured to sense the mass and/or flow rates or volumes of at least the diverted bitumen stream 110*a* and the overhead bitumen stream 130, and optionally, the mixed bitumen stream 134.

The sensors may further sense the ratio of solvent to bitumen in the overhead stream 130. In another exemplary embodiment, an optical sensing system may be utilized to determine the solvent content and/or asphaltene content of the overhead stream by a particle size distribution method such as that disclosed in U.S. Pat. App. Nos. 61/066,183 and 61/065,371, which are hereby incorporated by reference for said purpose. Alternatively, automated titration tests, known by those of skill in the art, may be used to determine or verify the compatibility parameters and the incompatibility numbers of the streams 130, 110*a*, and 134. Although primarily automated means and methods of operation are possible, it may be preferable that the control unit 140 be at least partially manual. For example, a manual distillation test may be performed to determine or verify the incompatibility number ($I_N$) of the stream 130 and/or the solubility blending number of the mixed bitumen stream 134. Generally, the automated titration approach is preferable due to increased accuracy and the ability to measure the $I_N$ even when it is much lower than the $S_{BN}$.

In particular, the control unit 140 may be configured to change the flow rate of the streams 110*a* and 130 in response to any changes in the incompatibility number, temperatures, pressures, or other factors that affect the solubility blending number of the mixed bitumen stream 134. The control unit 140 may further be configured to calculate the effect of temperature dependence on the solubility parameters (δ) of the streams 130 and 110*a* and the entropic effect of the higher temperature favoring solubility. As with the sensing means of the plant 100, the control unit 140 may be fully automated, fully manual, or some combination of automated components and manual components.

The automated or partially automated control unit 140 may comprise a specially constructed control system for the required purposes, or it may comprise a general-purpose computer selectively activated or reconfigured by a computer program stored in the computer to control elements of the control unit 140. Such a computer program may be stored in a computer readable medium. A computer-readable medium includes any mechanism for storing or transmitting information in a form readable by a machine (e.g., a computer). For example, but not limited to, a computer-readable (e.g., machine-readable) medium includes a machine (e.g., a computer) readable storage medium (e.g., read only memory ("ROM"), random access memory ("RAM"), magnetic disk storage media, optical storage media, flash memory devices, etc.), and a machine (e.g., computer) readable transmission medium (electrical, optical, acoustical or other form of propagated signals (e.g., carrier waves, infrared signals, digital signals, etc.)). A related computer may further include a display means; network access to a database for upload or download and have other capabilities known to those of skill in the art.

Furthermore, as will be apparent to one of ordinary skill in the relevant art, the modules, features, attributes, methodologies, and other aspects of the control unit 140 can be implemented as software, hardware, firmware or any combination of the three. Of course, wherever a component of the control unit 140 is implemented as software, the component can be implemented as a standalone program, as part of a larger program, as a plurality of separate programs, as a statically or dynamically linked library, as a kernel loadable module, as a device driver, and/or in every and any other way known now or in the future to those of skill in the art of computer programming. Additionally, the control unit 140 is in no way limited to implementation in any specific operating system or environment.

In some embodiments of the system, the plant 100 further includes a solvent-rich oil stream 120, which may be mixed with the bitumen froth 102. Further, the bypass diluted bitumen stream 106 may be sent or partially sent to the solvent recovery unit (SRU) 108, which separates bitumen from solvent to produce a bitumen stream 110 that meets pipeline specifications. In addition, the solvent stream 112 may be mixed with the tailings stream 114 from the first FSU 104 and fed into a second froth separation unit (FSU) 116. The second FSU 116 produces a solvent rich oil stream 120 and a tailings stream 118. The solvent rich oil stream 120 may be mixed with the incoming bitumen froth 102 and the tailings stream is sent to a tailings solvent recovery unit (TSRU) 122, which produces a tailings stream 124 and a solvent stream 126, which may be mixed with solvent stream 112 and provided to the tailings stream 114 prior to introducing stream 114 to the second FSU 116. In the case where there is only one FSU 104, the solvent stream 112 may be introduced directly to the bitumen stream 102 and stream 114 would flow directly to TSRU 122.

In an exemplary embodiment of the process the bitumen froth 102 may be mixed with a solvent-rich oil stream 120 from FSU 116 in FSU 104. The temperature of the first FSU 104 may be maintained at about 60 to about 80 degrees Celsius (° C.), or about 70° C. and the target solvent to bitumen ratio of the bitumen froth 102 may be about 1.4:1 to about 2.2:1 by volume or about 1.6:1 by volume. The overflow from FSU 104 is the diluted bitumen product 106 and/or the overhead bitumen stream 130. The overflow 130 has about the same temperature as the bitumen froth 102, but has a solvent/bitumen mass ratio of from about 1.8:1 to about 2.2:1. The bitumen component may have a density of from about 0.9 grams per cubic centimeter (g/cc) to about 1.1 g/cc and the solvent component may have a density of from about 0.60 g/cc to about 0.65 g/cc making the volume ratio of solvent/bitumen from about 3.5:1 to about 3.0:1.

The bottom stream 114 from first FSU 104 is the tailings substantially comprising water, mineral solids, asphaltenes, and some residual bitumen. The residual bitumen from this bottom stream is further extracted in second FSU 116 by contacting it with fresh solvent (from e.g., 112 or 126), for example in a 25:1 to 30:1 by weight solvent to bitumen ratio at, for instance, about 80 to about 100° C., or about 90° C. The solvent-rich overflow 120 from FSU 116 may be mixed with the bitumen froth feed 102. The bottom stream 118 from FSU 116 is the tailings substantially comprising solids, water, asphaltenes, and residual solvent. The bottom stream 118 may be optionally fed into a tailings solvent recovery unit (TSRU) 122, a series of TSRUs or by another recovery method. In the TSRU 122, residual solvent is recovered and recycled in stream 126 prior to the disposal of the tailings in the tailings ponds (not shown) via a tailings flow line 124. Exemplary operating pressures of FSU 104 and FSU 116 are respectively 550 thousand Pascals gauge (kpag) and 600 kPag. Note that the pressures need only be sufficient to prevent boiling off the solvent and different solvents will require different pressures. FSUs 104 and 116 are typically made of carbon-steel but may be made of other materials. Also, the FSUs 104 and 116 and conduits carrying the heavy hydrocarbon streams may be treated with a coating such as a PTFE-type coating or other non-stick coating configured to reduce fouling.

The mixing unit 132 may be any type of mixer designed to mix two substantially fluidous streams, such as a static mixer, a rotating mixer, a shear plate mixer, an in-line mixer, or other kinetic mixer. The mixing unit 132 may include a coating such as a PTFE-type coating or other non-stick coating configured to reduce fouling. Exemplary coating approaches and embodiments may be found, for example, in Canadian Pat. App. No. 2,594,205, which is hereby incorporated by reference for said purpose. The heating unit 136 may be any type of heater capable of imparting heat to the mixed bitumen stream 134 and may be a stand-alone unit, combined with another heater, utilize cross-flow heat from another portion of the plant 100, be directly electrically heated, and be partially or fully integrated with the SRU 108.

Figure 2:
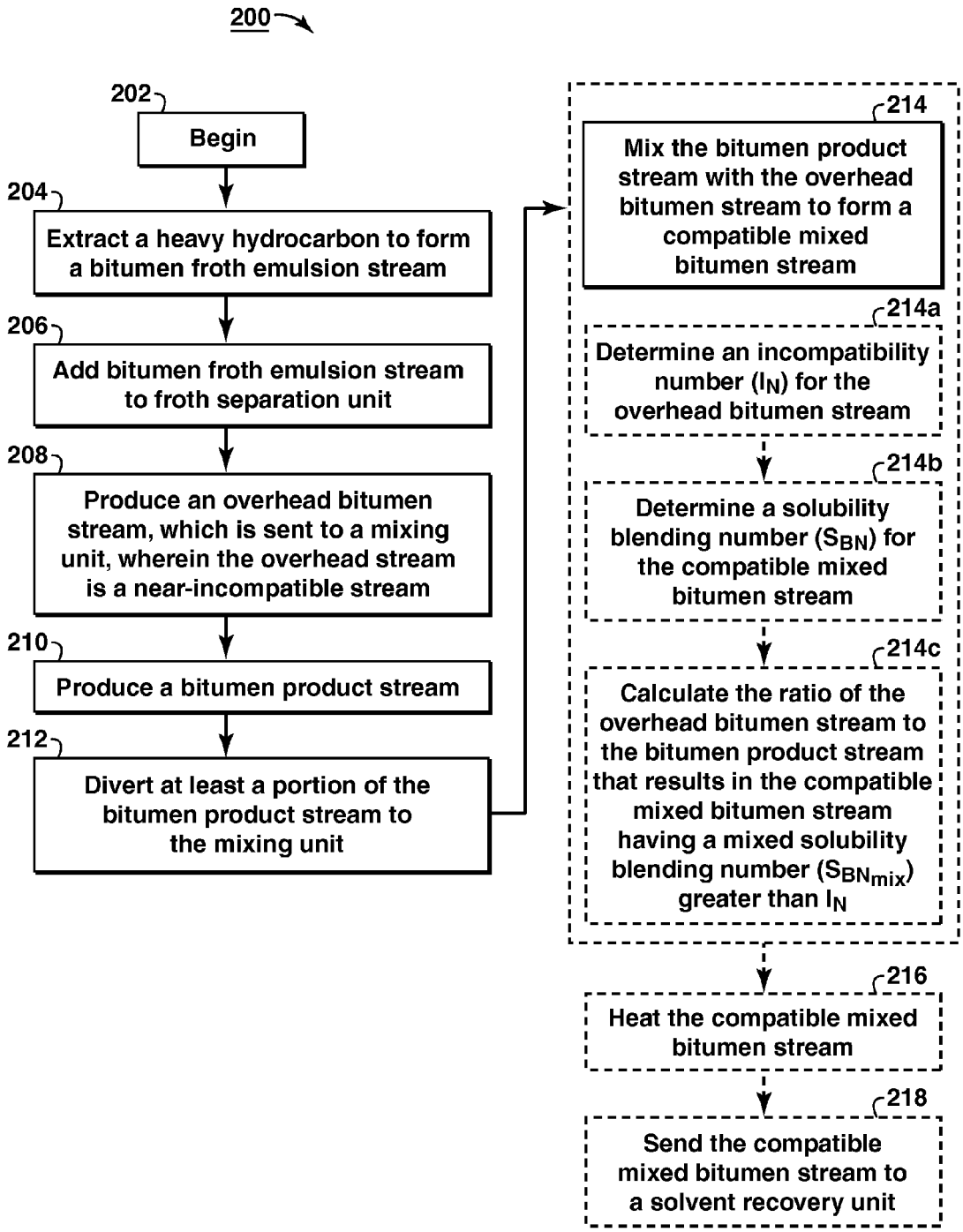
FIG. 2 is a flow chart of an exemplary hydrocarbon treatment process including at least one aspect of the present invention.

FIG. 2 is a flow chart of an exemplary process for recovering hydrocarbons utilizing at least a portion of the system disclosed in FIG. 1. As such, FIG. 2 may be best understood with reference to FIG. 1. The process 200 begins at block 202, then includes extraction of a heavy hydrocarbon 204 to form a bitumen froth emulsion stream. After extraction 204, the bitumen froth is added 206 to a froth separation unit (FSU), which produces 208 at least an overhead bitumen stream, which is sent to a mixing unit, wherein the overhead bitumen stream is a near-incompatible stream. A solvent recovery unit produces 210 at least a bitumen product stream. At least a portion of the bitumen product stream is diverted 212 to the mixing unit and is mixed 214 with the overhead stream to form a compatible mixed bitumen stream. In one particular embodiment of the process 200, the compatible mixed bitumen stream may be heated 216 and sent 218 to the solvent recovery unit.

In an additional embodiment of the process 200, the mixing step 214 may further include a number of steps designed to ensure that the solubility parameter (or solubility blending number $S_{BNmix}$) of the compatible mixed bitumen stream is greater than a compatibility limit of the compatible mixed bitumen stream. In particular, the mixing step 214 may further include the sub-steps of: determining 214*a* an incompatibility number ($I_N$) for the overhead bitumen stream; determining 214*b* a solubility blending number ($S_{BN}$) for the compatible mixed bitumen stream; and calculating 214*c* the ratio of the overhead bitumen stream to the bitumen product stream that results in a compatible mixed bitumen stream having a mixed solubility blending number ($S_{BNmix}$) greater than the incompatibility number of the overhead bitumen stream.

Still referring to FIGS. 1 and 2, the step of extracting the heavy hydrocarbon (e.g., bitumen) 204 may include using a froth treatment resulting in a bitumen-froth mixture. An exemplary composition of the resulting bitumen froth 102 is about 60 wt % bitumen, 30 wt % water and 10 wt % solids, with some variations to account for the extraction processing conditions. In such an extraction process oil sands are mined, bitumen is extracted from the sands using water (e.g., the CHWE process or a cold water extraction process), and the bitumen is separated as a froth comprising bitumen, water, solids and air. In the extraction step 204 air is added to the bitumen/water/sand slurry to help separate bitumen from sand, clay and other mineral matter. The bitumen attaches to the air bubbles and rises to the top of the separator (not shown) to form a bitumen-rich froth 102 while the sand and other large particles settle to the bottom. Regardless of the type of water based oil sand extraction process employed, the extraction process 204 will typically result in the production of a bitumen froth product stream 102 comprising bitumen, water and fine solids (including asphaltenes, mineral solids) and a tailings stream 114 consisting essentially water, mineral solids, fine solids (sand) and the precipitated asphaltenes with some residual bitumen oil.

In one embodiment of the process 200 solvent 120 is added to the bitumen-froth 102 after extraction 204 and the solvent-enhanced bitumen froth is pumped to another separation vessel (froth separation unit or FSU 104). The addition of solvent 120 helps remove the remaining fine solids and water. Put another way, solvent addition increases the settling rate of the fine solids and water out of the bitumen mixture. In one embodiment of the recovery process 200 a paraffinic solvent is used to dilute the bitumen froth 102 before separating the product bitumen by gravity in a device such as first FSU 104. Where a paraffinic solvent is used (e.g., when the weight ratio of solvent to bitumen is greater than 0.8), a portion of the asphaltenes in the bitumen are rejected thus achieving solid and water levels that are lower than those in existing naphtha-based froth treatment (NFT) processes. In the NFT process, naphtha may also be used to dilute the bitumen froth 102 before separating the diluted bitumen by centrifugation (not shown), but not meeting pipeline quality specifications. In particular, solvents such as toluene, pentanes, and heptanes may be used.

As would be expected with any process, the optimum conditions would be required to produce the largest average particle size and subsequently the fastest settling time. Variables that should be optimized include, but are not limited to; water-to-bitumen ratio (e.g., from 0.01 weight percent (wt %) to 10 wt %), mixing energy, temperature, and solvent addition.

Figure 3:
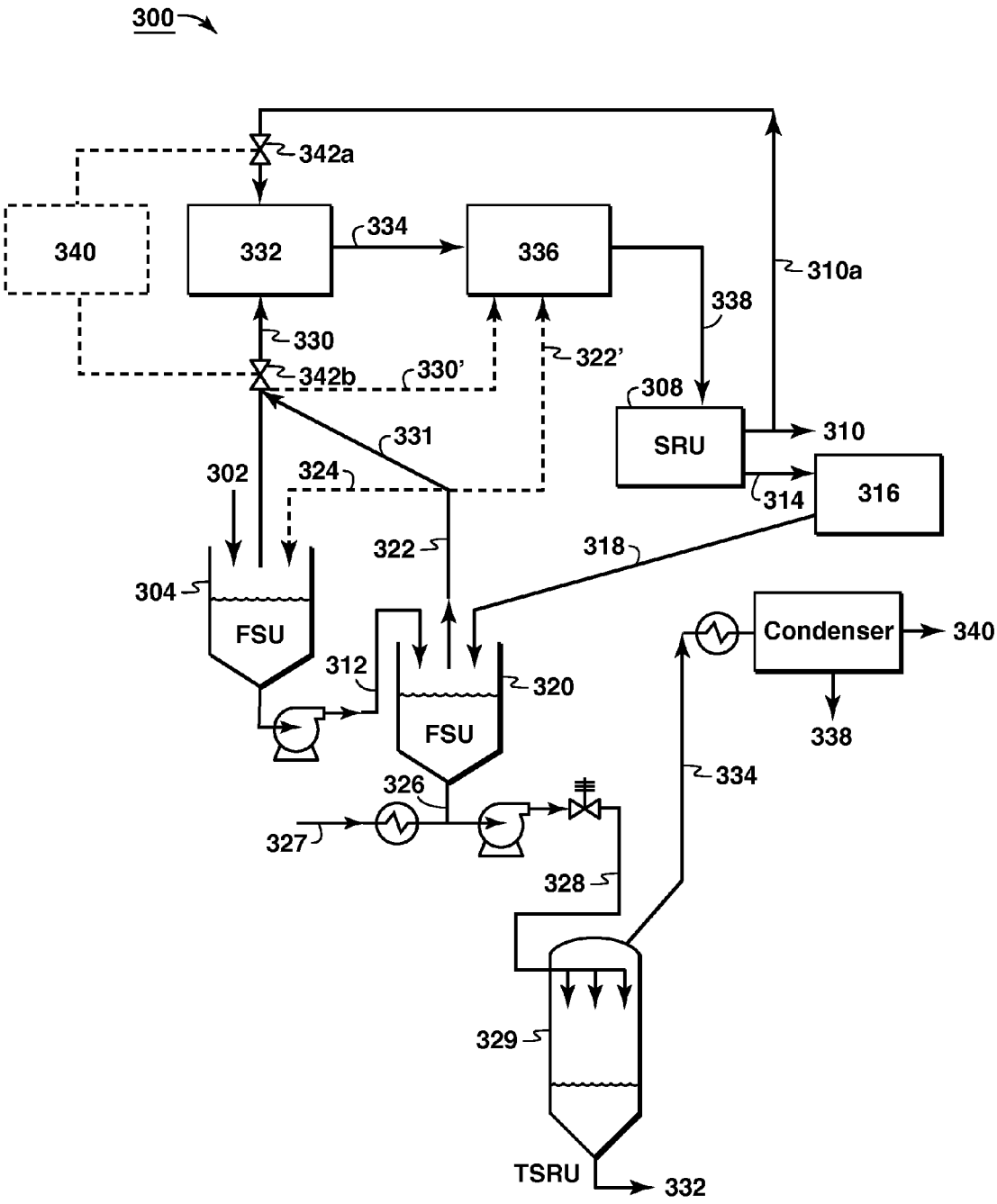
FIG. 3 is a schematic of an exemplary bitumen froth treatment plant layout including at least one aspect of the present invention.

FIG. 3 is an exemplary schematic of a bitumen froth treatment plant layout utilizing the process of FIG. 2. As such, FIG. 3 may be best understood with reference to FIG. 2. The plant 300 includes a bitumen froth input stream 302 input to a froth separation unit (FSU) 304, which separates stream 302 into a diluted bitumen component 330 comprising bitumen and solvent and a froth treatment tailings component 312 substantially comprising water, mineral solids, precipitated asphaltenes (and aggregates thereof), solvent, and small amounts of unrecovered bitumen. The tailings stream 312 may be withdrawn from the bottom of FSU 304, which may have a conical shape at the bottom.

The diluted bitumen component 330 may be split to form a bypass or partial bypass stream 330' which is passed through a heater 336 and a solvent recovery unit, SRU 308, such as a conventional fractionation vessel or other suitable apparatus in which the solvent 314 is flashed off and condensed in a condenser 316 associated with the solvent flashing apparatus and recycled/reused in the plant 300. The solvent free bitumen product 310 may then be stored or transported for further processing or may be at least partially diverted via line 310*a* to a mixing unit 332 for mixing with diluted bitumen stream 330 to form mixed bitumen stream 334. The plant 300 further includes a heating unit 336 which produces a heated mixed bitumen stream 338 to be fed into the SRU 308. The heating unit 334 may also be configured to heat the optional bypass stream 330' or stream 322'. Froth treatment tailings component 312 may be passed directly to the tailings solvent recovery unit (TSRU) 329 or may first be passed to a second FSU 320.

In one exemplary embodiment, the plant 300 further includes a control unit 340 and may include valves 342*a* and 342*b* for controlling the flow of the diverted bitumen product stream 310*a* and the overhead bitumen stream 330 into the mixing unit 332. Although valves may be used, any means of controlling the relative flow of the streams 330 and 310*a* may be used. Other exemplary means include accumulation tanks, pumps, etc. The controller may further be coupled to sensors (not shown) which are configured to sense the mass and/or flow rates or volumes of at least the diverted bitumen stream 310*a* and the overhead bitumen stream 330, and optionally, the mixed bitumen stream 334. The sensors of plant 300 may operate much like the sensors of plant 100, as disclosed above.

In particular, the control unit 140 may be configured to change the flow rate of the streams 310*a*, 330, and 331 in response to any changes in the incompatibility number, temperatures, pressures, or other factors that affect the solubility blending number of the mixed bitumen stream 334. Note that the plant 300 includes additional lines connecting the second FSU 320 to the mixing unit 332. The control unit 340 may further be configured to calculate the effect of temperature dependence on the solubility parameters (δ) of the streams 330, 331, and 310*a* and the entropic effect of the higher temperature favoring solubility. As with the sensing means of the plant 100 and 300, the control unit 340 may be fully automated, fully manual, or some combination of automated components and manual components. An automated or partially automated control unit 340 may comprise a specially constructed or modified general-use programmed computer system having an active memory, a long-term memory, an input means, and a display means. Such a computer system may include network access to a database for upload or download and have other capabilities known to those of skill in the art.

In one embodiment, FSU 304 operates at a temperature of about 60° C. to about 80° C., or about 70° C. In one embodiment, FSU 304 operates at a pressure of about 700 to about 900 kPa, or about 800 kPa. Like in plant 100, the pressure is highly dependent on the type of solvent used. Diluted tailings component 312 may typically comprise approximately 50 to 70 wt % water, 15 to 25 wt % mineral solids, and 5 to 25 wt % hydrocarbons. The hydrocarbons comprise asphaltenes (for example 2.0 to 12 wt % or 9 wt % of the tailings), bitumen (for example about 7.0 wt % of the tailings), and solvent (for example about 8.0 wt % of the tailings). In additional embodiments, the tailings comprise greater than 1.0, greater than 2.0, greater than 3.0, greater than 4.0, greater than 5.0, greater than 10.0 wt % asphaltenes, or about 15.0 wt % asphaltenes.

Still referring to FIG. 3, FSU 320 performs generally the same function as FSU 304, but is fed the tailings component 312 rather than a bitumen froth feed 302. The operating temperature of FSU 320 may be higher than that of FSU 304 and may be between about 80° C. and about 100° C., or about 90° C. In one embodiment, FSU 320 operates at a pressure of about 700 to about 900 kPa, or about 800 kPa. A diluted bitumen component stream 322 comprising bitumen and solvent is removed from FSU 320 and may optionally be diverted wholly or partially to FSU 304 via line 324 for use as solvent to induce asphaltene separation or is passed to SRU 308 via line 322' and heater 336 or to an another SRU (not shown) for treatment in the same way as the diluted bitumen component 330. The ratio of solvent:bitumen in diluted bitumen component 322 may be, for instance, 1.4 to 30:1, or about 20:1. Alternatively, diluted bitumen component 322 may be partially passed to FSU 304 via line 324 and partially passed to SRU 308 via line 325, or to another SRU (not shown). Solvent 314 from SRU 308 may be combined with the diluted tailing stream 312 into FSU 320, shown as stream 318, or returned to a solvent storage tank (not shown) from where it is recycled to make the diluted bitumen froth stream 302. Thus, streams 322 and 318 show recycling. In the art, solvent or diluted froth recycling steps are known such as described in U.S. Pat. No. 5,236,577, which is hereby incorporated by reference for said purpose.

In the exemplary system of FIG. 3, the froth treatment tailings 312 or tailings component 326 (with a composition similar to underflow stream 312 but having less bitumen and solvent), may be combined with dilution water 327 to form diluted tailings component 328 and is sent to TSRU 329. Diluted tailings component 328 may be pumped from the FSU 320 or FSU 304 (for a single stage FSU configuration) to TSRU 329 at the same temperature and pressure in FSU 320 or FSU 304. A backpressure control valve may be used before an inlet into TSRU 329 to prevent solvent flashing prematurely in the transfer line between FSU 320 and TSRU 329.

Flashed solvent vapor and steam (together 334) is sent from TSRU 329 to a condenser 336 for condensing both water 338 and solvent 340. Recovered solvent 340 may be reused in the bitumen froth treatment plant 300. Tailings component 332 may be sent directly from TSRU 329 to a tailings storage area (not shown) for future reclamation or sent to a second TSRU (not shown) or other devices for further treatment. Tailings component 332 contains mainly water, asphaltenes, mineral matter, and small amounts of solvent as well as unrecovered bitumen. A third TSRU (not shown) could also be used in series and, in each subsequent stage, the operating pressure may be lower than the previous one to achieve additional solvent recovery. In fact, more than three TSRU's could be used, depending on the quality of bitumen, pipeline specification, size of the units and other operating factors.

EXAMPLES

Experiments were conducted to test the effectiveness of blending pipeline quality bitumen with a high solvent ratio overhead stream to avoid precipitation.

Figure 4:
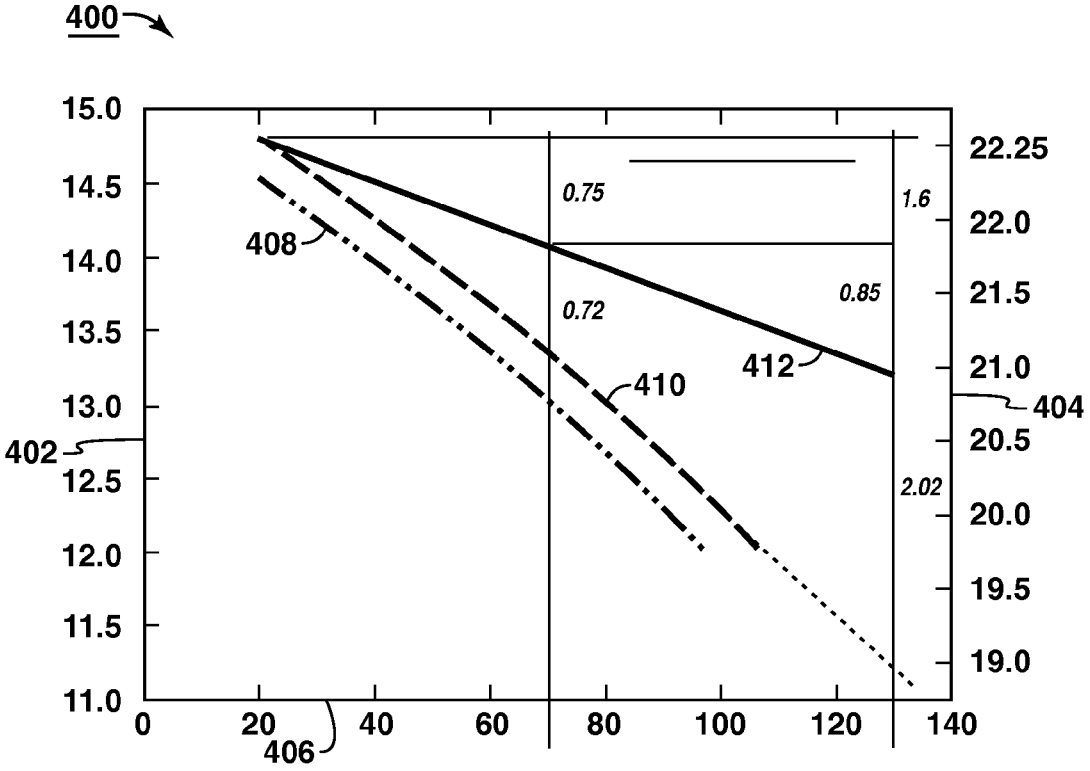
FIG. 4 is an illustrative graph showing the effect of temperature on the solubility parameter of some exemplary solvents.

FIG. 4 is a schematic illustration of the computed temperature dependent solubility parameters of solvents nC5 and iC5 and the asphaltenes in the bitumen at 100 psi. The pure nC5 and iC5 liquid phase is not computed as high as 130° C., however the values were extrapolated to those temperatures. Being mixed with the bitumen, they will remain in the liquid state until higher temperatures than in their pure state. The temperature dependence of the solubility parameter of the full bitumen will have essentially the same temperature dependent slope of the solubility parameter as the asphaltenes, although its value is lower.

Example 1

In one example, a combination of computations and experimental data were used to estimate the amount of bitumen (e.g., streams 110*a* or 310*a*) necessary to be added to a near-incompatible stream (e.g., streams 130, 330, and/or 331) to ensure compatibility of a mixed stream (e.g., 134 or 334) until the solvent is flashed. Assuming the "worst case" where all the heating is done, reaching a temperature of 130 degrees Celsius (° C.), before any solvent is allowed to enter the vapor phase. It was also assumed that any asphaltene precipitation proceeds to equilibrium before the pressure is dropped and the solvent is flashed. The greater decrease in solubility parameter with increased temperature of the solvent compared to the heavier fractions is also accounted for. Additionally, an accounting is made for entropic solubilization, which occurs at higher temperature. An exemplary estimate is that compatibility of the mixed streams (134 or 334) will be maintained if the solvent to bitumen volume ratio for the tested streams is decreased from 3.17 to 1.82, by recycling solvent-free bitumen (e.g., 110*a* or 310*a*) to the overflow (e.g., 130, 330, and/or 331) prior to the heat exchangers (e.g., 136 or 336). If solvent is flashed to the vapor phase as the temperature is increased or the solvent is removed fast enough before asphaltenes can precipitate, then the amount of bitumen added can be reduced.

We assume the overflow is at 70° C. and has a solvent/bitumen mass ratio of 2:1. The bitumen component has a density of 1.0 grams per cubic centimeter (g/cc) and the solvent's density is 0.63 g/cc. Thus, the volume ratio of solvent/bitumen is 3.17:1. The $S_{BN}$, $I_N$ scale is based on room-temperature solubility parameters of heptane and toluene, which are 15.3 and 18.3 $(\text{joule/cc})^{1/2}$ respectively. Solvents nC5 and iC5 have an average solubility parameter at room temperature (20° C.) of 14.65.

FIG. 4 is a graph illustrating the computed temperature dependent solubility parameters of nC5 and iC5 and the asphaltenes in the bitumen at 100 psi. Graph 400 includes a solubility parameter scale for nC5 and iC5 402 (no units) and a solubility parameter scale for asphaltenes 404 (no units) versus temperature 406 in degrees Celsius (° C.). The graph 400 displays plots of the solubility parameters (δ) of iC5 versus temperature 408, nC5 versus temperature 410, and asphaltenes versus temperature 412. An estimate of an $S_{BN}$ of the bitumen in the supernate (overflow) to be about 108. This corresponds to a room temperature solubility parameter of: (18.3−15.3)*(108−100)*0.01+18.3=18.54.

The temperature dependences are used to estimate how the difference in solubility parameters will change as the temperature is increased. We thus start with the $\delta_{C5}$=14.65 and $\delta_{bit}$=18.54 at 20° C. These are reduced respectively 1.47 and 0.75 units to $\delta_{C5}$=13.18 and $\delta_{bit}$=17.82 at 70° C. With a 3.17:1 volume ratio this gives a net $\delta_{mixture}$=14.29 at 70° C. This is the condition which is at the limit of incompatibility when the precipitated asphaltenes have settled in the Froth Settling Unit (e.g., 104 or 304). Having a marginally compatible mixture at 70° C., the question is how much bitumen from the solvent recovery unit 108 or 308 must be added back to the overflow 130 or 330 to keep the mixture compatible when the temperature is raised to 130° C. at pressure, before any solvent is flashed.

The entropic effect of heating can be computed using a simple parameterization which allows the computation of the effective reduction in $I_N$ with increased temperature. In this case, for an increase of 60° C. the tolerated decrease in $\Delta\delta$ would be 0.3.

Since the asphaltene solubility parameter will also drop 0.85 with increased temperature (from 70° C. to 130° C.), we can tolerate a decrease of 0.85, as well as an additional decrease of 0.3 due to the entropic effect of heating. Thus, at 130° C. we need $\delta_{mixture}$ greater than 13.14. At 130° C., the solubility parameters of C5 drops to $\delta_{C5}$=11.04 and the bitumen drops 0.85 to $\delta_{bit}$=16.97. Thus, the same 3.17:1 mixture would only have $\delta_{mixture}$=12.46, and would be incompatible.

To maintain the marginal compatibility with $\delta_{mixture}$>13.14, the solvent to bitumen ratio is decreased to (16.97−13.14)/(13.14−11.04)=1.82. Thus, 0.178 parts bitumen would need to be added to 1 part overflow (by volume). This translates to adding 0.74 parts bitumen for 1 part bitumen in the overflow. This amounts to increasing the feed volume by 18% and the SRU output volume by 74%, with that increase being recycled. The above is an exemplary estimate based on the calculations given. However, these measurements and calculations can be made and adjusted for a wide variety of conditions in a bitumen treatment plant.

While the present disclosure may be susceptible to various modifications and alternative forms, the exemplary embodiments discussed above have been shown only by way of example. However, it should again be understood that the disclosure is not intended to be limited to the particular embodiments disclosed herein. Indeed, the present invention includes all alternatives, modifications, and equivalents falling within the true spirit and scope of the appended claims.

What is claimed is:

1. A method of recovering hydrocarbons, comprising:

producing a bitumen (or other heavy oil) froth stream including solvent and asphaltenes;

sending at least a portion of the bitumen stream to an overhead line (the overhead bitumen stream), wherein the overhead bitumen stream is a near-incompatible stream including solvent;

providing a solvent recovery unit configured to produce a bitumen product stream and a solvent stream;

diverting at least a portion of the bitumen product stream (the diverted bitumen product stream) to a mixing unit; and mixing the overhead bitumen stream with the diverted bitumen product stream in the mixing unit to produce a compatible mixed bitumen stream.

2. The method of claim 1, further comprising;

heating the compatible mixed bitumen stream to generate a heated mixed bitumen stream; and sending the heated mixed bitumen stream to the solvent recovery unit (SRU).

3. The method of claim 2, wherein the solvent in the near-incompatible overhead bitumen stream has a flow rate to the mixing unit, the diverted bitumen product stream has a flow rate to the mixing unit, and a ratio of the flow rate of the solvent in the overhead bitumen stream to the diverted bitumen product stream is configured to increase a solubility parameter of the compatible mixed bitumen stream.

4. The method of claim 3, wherein the solubility parameter of the compatible mixed bitumen stream is greater than a compatibility limit of the compatible mixed bitumen stream.

5. The method of any one of claims 1 and 3, further comprising:

determining an incompatibility number ($I_N$) for the overhead bitumen stream;

determining a solubility blending number ($S_{BN}$) for the compatible mixed bitumen stream; and calculating the ratio of the overhead bitumen stream to the bitumen product stream that results in a compatible mixed bitumen stream having a mixed solubility blending number ($S_{BNmix}$) greater than the incompatibility number of the overhead bitumen stream.

6. The method of claim 5, wherein the ratio is selected from the group of ratios consisting of a volume ratio, a mass ratio, a weight ratio, a molar ratio, a volume flow rate ratio, a mass flow rate ratio, a weight flow rate ratio, and a molar flow rate ratio.

7. The method of claim 5, wherein the overhead bitumen stream is at a temperature of from about 50 degrees Celsius (° C.) to about 90° C. and the heated mixed bitumen stream is at a temperature of from about 100° C. to about 150° C.

8. The method of claim 7, wherein the solvent is selected from the group comprising: butanes, pentanes, heptanes, octanes, and any combination thereof.

9. The method of claim 8, wherein the volume ratio of solvent to bitumen in the compatible mixed bitumen stream is less than about 2:1.

10. The method of claim 5, wherein at least some of the steps are performed by a computer program stored on a computer-readable medium.

* * * * *